United States Patent [19]

Duncan

[11] Patent Number: 4,723,633

[45] Date of Patent: Feb. 9, 1988

[54] ADJUSTING SCREW RETAINER

[75] Inventor: Charles W. Duncan, Long Beach, Calif.

[73] Assignee: WACO International Corporation, Cleveland, Ohio

[21] Appl. No.: 54,752

[22] Filed: May 26, 1987

[51] Int. Cl.[4] ..... E04G 5/02; E04G 1/24

[52] U.S. Cl. ..... 182/230; 182/179; 16/19; 16/30

[58] Field of Search ..... 182/230, 179, 178; 16/18 R, 19, 30, 32, 33, 42 T; 248/188.4

[56] References Cited

U.S. PATENT DOCUMENTS

| | | | |
|---|---|---|---|
| 1,247,827 | 11/1917 | Hansen | 16/19 |
| 2,010,299 | 8/1935 | Gray | 248/188.4 |
| 2,339,577 | 1/1944 | Nalle | 16/19 |
| 2,618,496 | 11/1952 | Johnson | 248/188.4 |
| 3,566,991 | 3/1971 | Proulx | 182/179 |
| 3,742,662 | 7/1973 | Ballou | 248/188.4 |
| 3,964,575 | 6/1976 | Gostling | 182/179 |
| 4,263,984 | 4/1981 | Masuda | 182/179 |

*Primary Examiner*—Reinaldo P. Machado

*Attorney, Agent, or Firm*—Pravel, Gambrell, Hewitt, Kimball & Krieger

[57] ABSTRACT

An apparatus for securing an adjusting screw having a nut thereon to an hollow leg of a scaffolding frame to prevent loss of the adjusting screw when the scaffolding frame is tilted or raised. The apparatus includes a swivel that allows turning of the handle nut while the adjusting screw remains secured to the leg of the scaffolding frame.

14 Claims, 6 Drawing Figures

ADJUSTING SCREW RETAINER

FIELD OF THE INVENTION

The invention relates generally to frame scaffolding, and more specifically to adjusting screws for leveling the frame scaffolding.

BACKGROUND OF THE INVENTION

Frame scaffolding is used on uneven ground by inserting adjusting screws into the hollow legs of the scaffolding. Each leg of the scaffolding generally rests upon a handle nut, and rotation of the handle nut raises or lowers the leg relative to the adjusting screw. The adjusting screws are normally attached to rollers or casters for allowing movement of the scaffolding from one location to another.

A problem with conventional adjusting screws is that the adjusting screws have not been secured to the legs of the scaffolding because holes for conventional locking pins can not be placed through the threads of the adjusting screws. Further, such securing by locking pins or similar means would prevent use of the screw adjustment unless the locking pins were removed, which removal would be too time-consuming for normal use.

As a result, the adjusting screw has thus been loosely located in each leg.

Rolling the scaffolding frame from one location to another can cause an inadvertent lifting or tilting of the scaffolding because of hitting a projection or due to sudden stopping. Such tilting has caused the raised casters to fall out, which drops one side or corner of the scaffolding. Equipment and personnel on the scaffolding are then no longer on a level surface and may fall from the scaffolding causing serious injury to personnel or damage to equipment. In an attempt to remedy that problem in the past, wire has been secured to the handle nut of the adjusting screw and the leg of the scaffolding. However, the use of wire prohibits turning of the handle nut without removing the wire, and when the wire is removed, it is often not replaced after height adjustments are made with the adjusting screw.

SUMMARY OF THE INVENTION

The present invention is an apparatus useful for securing an adjusting screw having a nut thereon to a hollow leg of a scaffolding frame, comprising a swivel adapted to secure the adjusting screw, and means for attaching the swivel to the hollow leg to allow turning of the handle nut and the swivel with respect to the leg. This invention allows turning of the nut to raise or lower the leg of the scaffolding while the adjusting screw remains secured to the leg. In a preferred embodiment, the apparatus is releasably connected to both the leg and the nut to simplify removal and repair.

DETAILED DESCRIPTION OF A PREFERRED EMBODIMENT

Figure 1B:
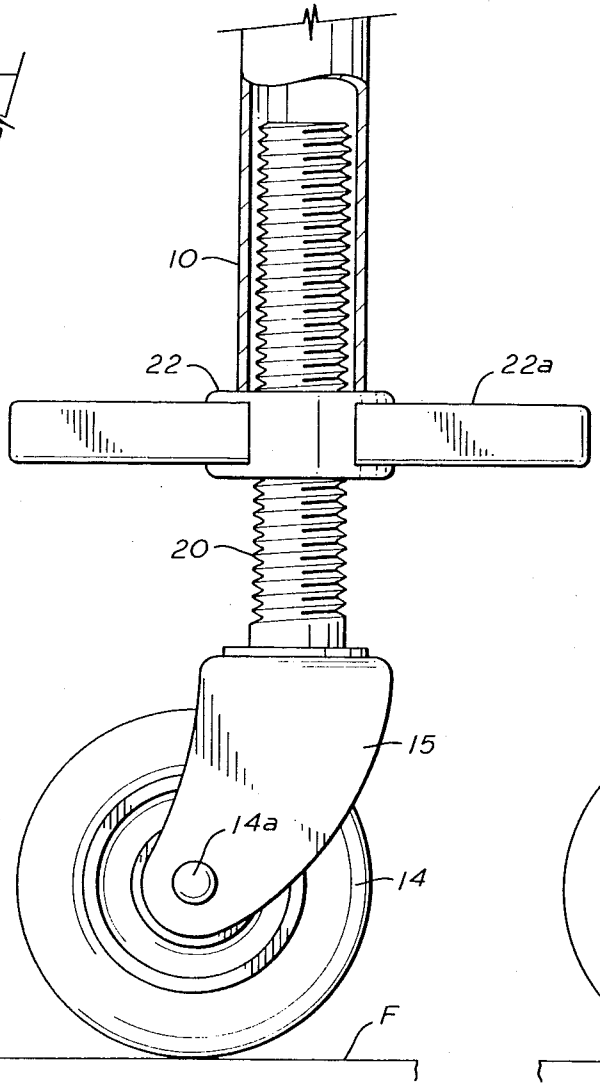
FIG. 1B (PRIOR ART)
FIGS 1A AND 1B illustrate prior art means for mounting a caster on a leg of a scaffolding frame, both with (FIG. 1B) and without (FIG. 1A), an adjusting screw.
Figure 1A:
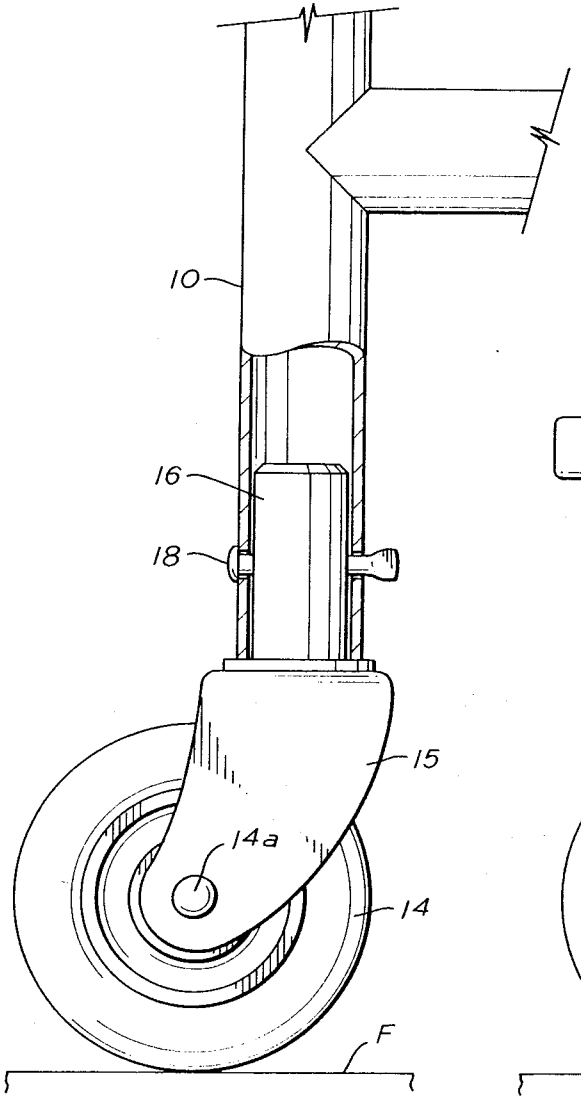
FIG. 1A (PRIOR ART)

The prior art method of securing a leg 10 of a scaffolding frame to a conventional caster 14 is shown in FIG. 1A. Typically, the caster 14 is in the form of a roller which rotates on an axle 14*a* that extends through the lower part of a bracket 15. The bracket 15 is mounted on a shaft 16 for swiveling movement so that the caster 14 can move 360° about the vertical axis of the shaft 16 which extends upwardly into the leg 10. The shaft 16 is secured to the leg 10 by a locking pin 18. Such arrangement is secure because the shaft 16 with caster 14 cannot inadvertently come out of the leg 10, but there is no means for adjusting the height of the leg, so that a platform (not shown) supported by four or more of the legs 10 on the casters 14 cannot be adjusted vertically or leveled if the casters 14 are on an unlevel floor F or other support surface. FIG. 1B shows a prior art structure using an adjusting screw 20 having a handle nut 22 as shown in FIG. 1B. In that form, the shaft 16 is replaced by the adjusting screw 20, but otherwise the caster 14, axle 14*a* and bracket 15 are the same, and function the same. The leg 10 rests upon the handle nut 22. The handle nut 22 is turned to move upwardly or downwardly on the screw 20 to thereby raise or lower the leg 10. The nut 22 is not secured to the leg 10.

The preferred embodiment of the adjusting screw retainer of this invention shown in FIGS. 2 through 5 releasably secures the handle nut 22 of the adjusting screw 20 to the leg 10 of the scaffolding frame. Referring to FIGS. 2–5, a swivel 30 is annular except for a slot 32 on each side which allows the handle portions 22*a* of the handle nut 22 to project therethrough.

A retaining spring clip 34 has a bowed configuration with opposite portions 34*a* engaging the swivel 30 and portions 34*b* spaced outwardly from such swivel 30. The retaining spring clip 34 has a pair of oppositely disposed depending arms 36 to which are mounted a pair of retainer pins 38. The pins 38 extend into holes 30*a* in the swivel 30 when the retaining spring clip 34 is positioned on the swivel 30. The depending arms 36 on the retaining spring clip 34 are bent inwardly from the clip portions 34*b* so that the lower portion of each is in contact with the swivel 30, urging the pins 38 inwardly at all times so that they stay in the holes 30*a* until released. The pins 38 are pivoted from the holes 30*a* in the swivel 30 when the retaining spring clip 34 is squeezed radially inwardly as indicated by the dash lines in FIG. 2 and by the arrows 35 in FIG. 5. As will be more evident hereinafter, when the pins 38 are positioned within the holes in the swivel 30, the pins 38 act as stops to prevent the handle nut 22 from being removed from the swivel 30.

Referring again to FIGS. 2–5, the swivel 30 is connected to the leg 10 of the scaffolding frame (not shown) by a sleeve or connecting member 40 which slips over the leg 10. The sleeve 40 has a flared lower end 42 which extends under a lip 30*c* of the swivel 30 to prevent the base 40 from being separated from the swivel 30. An annular ring or washer 44 is welded or otherwise secured to the sleeve 40 so that the top 30*c* of the swivel 30 is confined between the washer 44 and the flared end 42 of the base 40. The swivel 30 is not directly fixed to the sleeve 40 and can turn or rotate about the vertical axis freely with respect to the sleeve 40.

Figure 2:
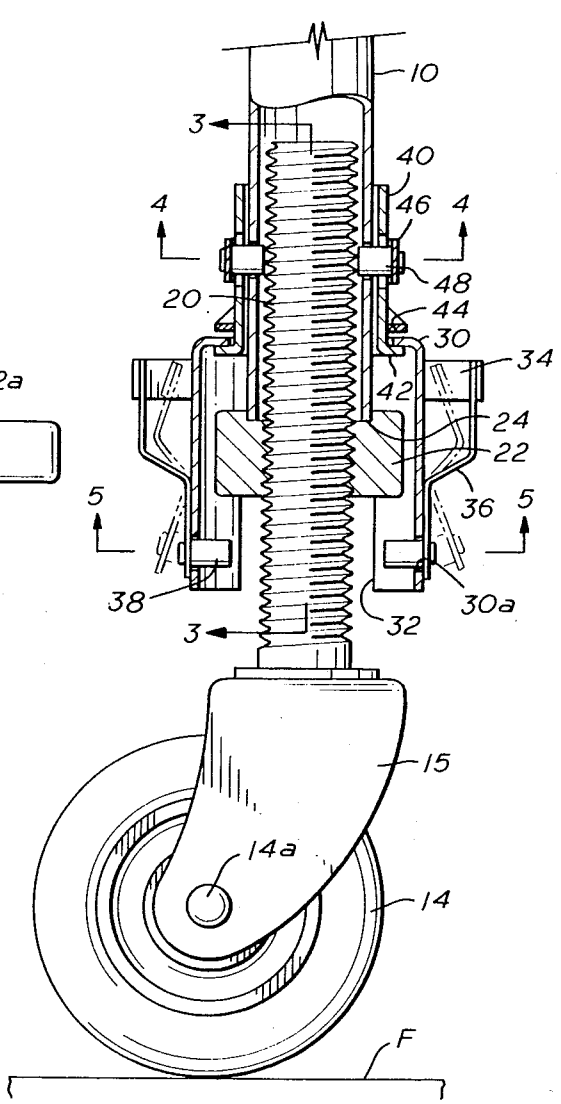
FIG. 2 shows the preferred adjusting screw retainer of this invention for releasably securing an adjusting screw having a handle nut to a leg of a scaffolding frame.
Figure 4:
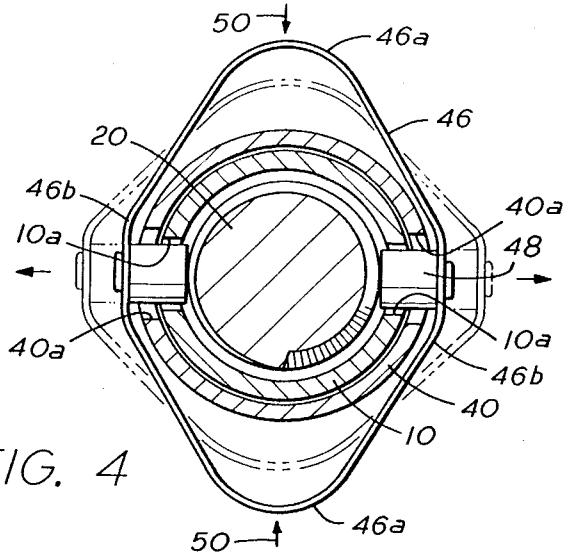
FIG. 4 is an enlarged sectional view taken on line 4—4 of FIG. 2, and shows the details of a preferred means for releasably connecting the adjusting screw retainer to the leg of the scaffolding frame.
Figure 3:
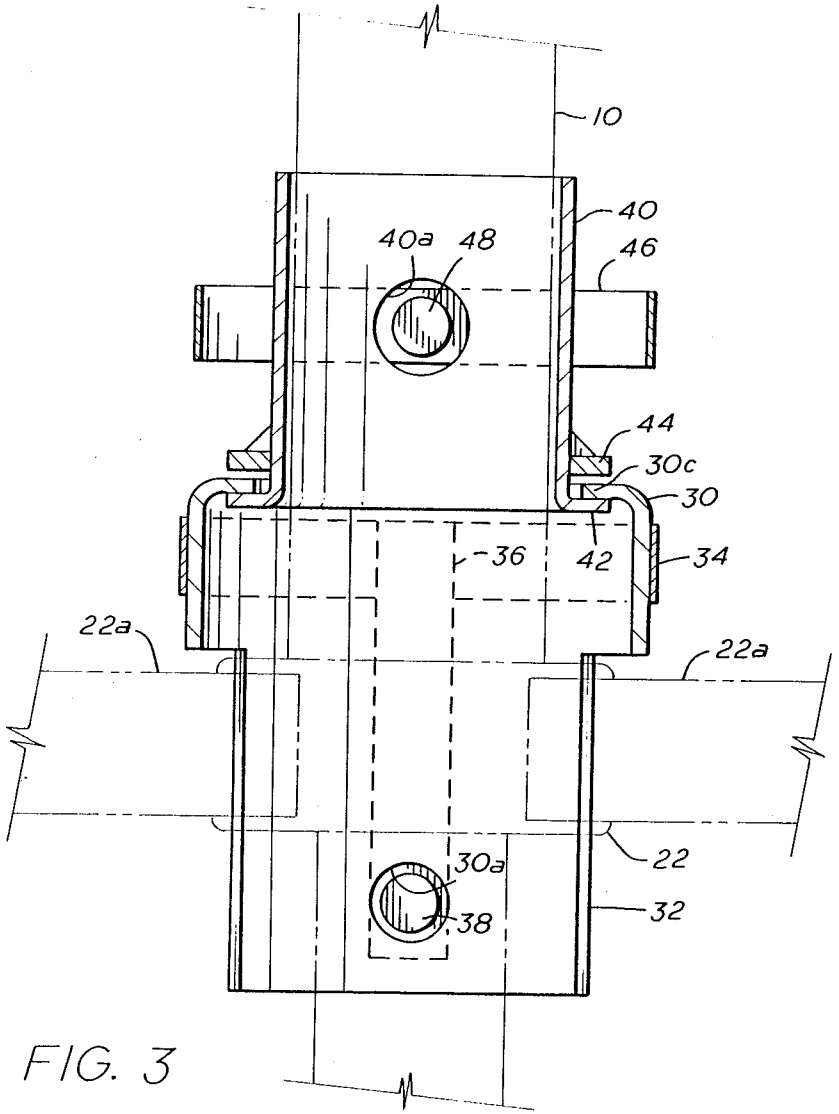
FIG. 3 is an enlarged sectional view taken on line 3—3 of FIG. 2, and shows the preferred embodiment of FIG. 2 apart from the adjusting screw and the leg of the scaffolding frame.

Referring to FIGS. 2 through 4, the sleeve 40 is releasably secured to the leg 10 of the scaffolding frame with a locking spring clip 46. The clip 46 is bowed so that opposite portions 46*a* are spaced outwardly away from the sleeve 40. Inner opposite portions 46*b* of the clip 46 are formed so as to be closer to the sleeve 40. A pair of pins 48 are mounted on the portions 46*b* of the locking spring clip 46, and they extend into holes 40*a* in the sleeve 40 and holes 10*a* in the leg 10. The spring clip 46 normally urges or holds the pins 48 in the holes 40*a* and 10*a* so as to lock the sleeve 40 to the leg 10. The pins 48 are removed from the holes in the base 40 and the leg 10 by squeezing the clip portions 46*a* to bow out the clip portions 46*b* to cause the pins 48 to be withdrawn radially outwardly from the holes 10*a* and 40*a*.

In the use of the apparatus of this invention, it can best be seen in FIG. 2 that the leg 10 rests upon the nut portion of the handle nut 22 in the annular recess 24. When it is desired to raise or lower the leg 10 relative to the floor F, this can be accomplished by rotating the handle nut 20, using the handle portions 22*a*. Since the swivel 30 can rotate relative to the sleeve 40 and the leg 10, there is no need to disconnect any of the apparatus of this invention from the leg 10 to accomplish such rotation of the handle nut 22 and thus the vertical change in the position of the leg 10.

Also, in a scaffolding apparatus which employs four or more of the legs 10 with the apparatus of this invention as shown in FIG. 2, should any of the casters 14 hit an obstruction or be slowed down so as to tend to cause a slight tilting in the direction of movement of the scaffolding apparatus, the casters 14 cannot fall out of the legs 10 because the only movement permitted is the extent of movement from the bottom of the nut 22 to the retainer pins 38. The pins 38 thus act as stops to limit the amount of movement of the threaded shaft 20 with respect to the leg 10. Therefore, the amount of tilting movement that results under normal circumstances is not sufficient to cause equipment or personnel on the platform of the scaffolding to fall or be thrown from the platform of the scaffolding. Also, because such construction prevents the release of the casters from the legs at the rear of the scaffolding during movement thereof, it also prevents a reverse tilting of the scaffolding which would occur if the rear casters were released from their legs and the scaffolding tilted backwardly after stopping. Thus, the problems of casters falling from the legs of scaffolding as in the prior art referred to above has been obviated with the present invention.

At the same time, the vertical adjustment of the legs of the scaffolding is accomplished without removing any pins such as the pins 18 shown in FIG. 1.

Figure 5:
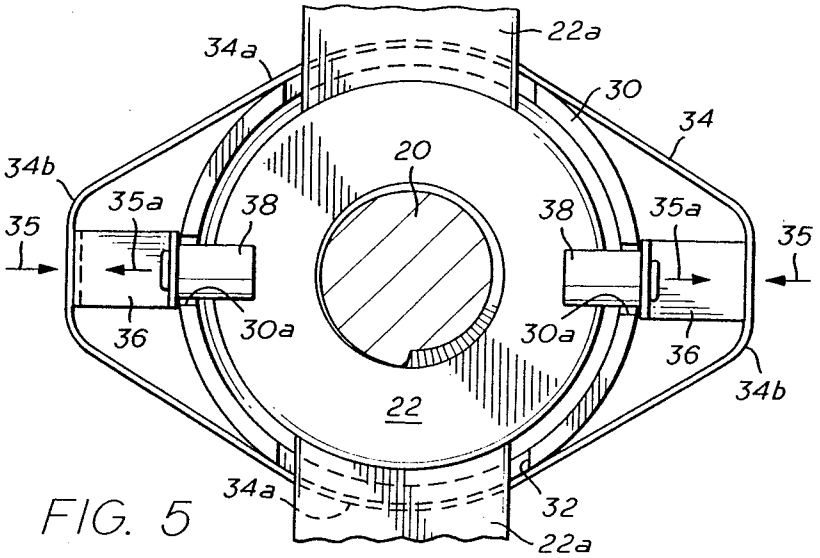
FIG. 5 is an enlarged sectional view taken on line 5—5 of FIG. 2, and shows the details of the preferred means for releasably securing the adjusting screw retainer to the handle nut of the adjusting screw.

When it is desired to remove the caster 14 and the screw shaft 20 from the leg 10, the bowed portions 34*b* of the spring clip 34 are compressed inwardly as shown by the arrows 35 to cause the retainer pins 38 to move outwardly as shown by the arrows 35*a* in FIG. 5. The withdrawal of the pins 38 from the holes 30*a* thus is sufficient to allow the nut 22 to pass downwardly through the swivel 30 and to thereby enable the screw shaft 20 to be removed from the leg 10, leaving the screw retainer apparatus of this invention in place at the bottom of the leg 10 for future use if desired.

When it is desired to completely remove the apparatus of this invention from the leg 10, the upper spring clip 46 is compressed at its outer bowed portions 46*a* to withdraw the retainer pins 48 radially outwardly from the holes 10*a* and 40*a* to thus separate the connection of the sleeve 40 from the leg 10 so that the apparatus can be moved downwardly and away from the leg 10.

The positioning of the apparatus on the leg 10 occurs in the reverse order to that explained above with respect to the removal thereof from the leg 10.

It will be understood that the apparatus of the present invention is suitable for use on a single leg, but it is normally used on a scaffolding structure having four or more legs so as to permit an adjustment in the height of the scaffolding without the complications and problems of the prior art.

The term "hollow leg" as used herein is meant to include a leg which is only hollow at its lower portion as well as throughout the length thereof.

The foregoing disclosure and description of the invention are illustrative and explanatory thereof, and various changes in the size, shape and materials, as well in the details of the illustrated construction, may be made without departing from the spirit of the invention.

What is claimed is:

1. An apparatus for securing an adjusting-screw-having a nut thereon to a hollow leg, comprising:

a swivel adapted to engage said nut for rotation therewith relative to said screw;

means for attaching the swivel to said hollow leg to allow turning of the swivel and the nut therewith with respect to the leg; and releasable means with said swivel for limiting vertical movement of said screw relative to said leg to prevent an inadvertent release of said screw from said leg, but being releasable to permit the release of the nut and screw from the leg.

2. The apparatus of claim 1, wherein the means for attaching the swivel to the hollow leg comprises:

a connecting member rotatably attached to the swivel, the connecting member being adapted to be positioned externally of the leg; and means for releasably attaching the connecting member to the leg.

3. The apparatus of claim 2, wherein the means for releasably attaching connecting member to the leg comprises a locking spring clip.

4. The apparatus of claim 1, further comprising means for releasably securing the swivel to the adjusting screw.

5. The apparatus of claim 4, wherein the means for releasably securing the swivel to the adjusting screw comprises a retaining spring clip positioned to enclose the nut of the adjusting screw within the swivel.

6. An apparatus useful for adjusting the height of an hollow leg, comprising:

an adjusting screw having a nut mounted thereon, the nut being adopted to support the leg;

a swivel adapted to engage the nut; and means for securing the swivel to the leg to allow turning of the nut and the swivel with respect to the leg for adjusting the height of the leg.

7. The apparatus of claim 6, wherein the means for attaching the swivel to the hollow leg comprises:

a connecting member rotatably attached to the swivel, the connecting member being adapted to be positioned externally of the leg; and means for releasably attaching the connecting member to the leg.

8. The apparatus of claim 7, wherein the means for releasably attaching the connecting member to the leg comprises a locking spring clip.

9. The apparatus of claim 6, further comprising means for releasably securing the swivel to the nut of the adjusting screw.

10. The apparatus of claim 9, wherein the means for releasably securing the swivel to the nut comprises a retaining spring clip positioned to enclose the nut within the swivel.

11. The apparatus of claim 1, wherein:

said adjusting screw has a caster on its lower end.

12. The apparatus of claim 6, wherein:

said adjusting screw has a caster on its lower end.

13. A scaffolding having at least four hollow legs each of which has an adjusting screw extending into each leg, and a nut supporting each leg, the improvement comprising:

connecting means between each said nut and each said leg for permitting rotation of each said nut on each said screw to individually adjust the height of each said leg; and releasable means with said connecting means for preventing an inadvertent release of each said screw and nut from each said leg but permitting a release thereof to allow removal from each said leg.

14. The structure set forth in claim 13, including:

a caster on the lower end of each adjusting screw.

* * * * *